US009779657B2

(12) United States Patent
Kim et al.

(10) Patent No.: US 9,779,657 B2
(45) Date of Patent: Oct. 3, 2017

(54) ORGANIC LIGHT EMITTING DISPLAY DEVICE AND METHOD FOR DRIVING THE SAME

(71) Applicant: SAMSUNG DISPLAY CO., LTD., Yongin, Gyeonggi-Do (KR)

(72) Inventors: Min-Cheol Kim, Yongin (KR); In-Hwan Kim, Yongin (KR); Byung-Geun Jun, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 204 days.

(21) Appl. No.: 14/338,467

(22) Filed: Jul. 23, 2014

(65) Prior Publication Data

US 2015/0042692 A1 Feb. 12, 2015

(30) Foreign Application Priority Data

Aug. 12, 2013 (KR) ..... 10-2013-0095270

(51) Int. Cl.
*G09G 3/30* (2006.01)
*G09G 3/3233* (2016.01)

(52) U.S. Cl.
CPC ... *G09G 3/3233* (2013.01); *G09G 2300/0814* (2013.01); *G09G 2300/0819* (2013.01); *G09G 2300/0842* (2013.01); *G09G 2300/0861* (2013.01); *G09G 2310/0251* (2013.01); *G09G 2310/0262* (2013.01)

(58) Field of Classification Search
CPC .. G09G 3/12; G09G 3/14; G09G 3/30–3/3291
See application file for complete search history.

(56) References Cited

U.S. PATENT DOCUMENTS

| | | | | |
|---|---|---|---|---|
| 8,344,974 | B2 | 1/2013 | Kim et al. | |
| 2005/0179627 | A1 | 8/2005 | Hayafuji et al. | |
| 2006/0158396 | A1* | 7/2006 | Jo | G09G 3/3283 345/76 |
| 2007/0097040 | A1* | 5/2007 | Miyazawa | G06K 15/1209 345/77 |
| 2007/0126667 | A1* | 6/2007 | Nakamura | G09G 3/3233 345/76 |
| 2007/0262931 | A1* | 11/2007 | Peng | G09G 3/3233 345/76 |
| 2013/0099692 | A1* | 4/2013 | Chaji | H05B 37/02 315/224 |
| 2014/0028859 | A1 | 1/2014 | Kim et al. | |

FOREIGN PATENT DOCUMENTS

| | | | |
|---|---|---|---|
| KR | 10-2006-0078427 | A | 7/2006 |
| KR | 10-2010-0053345 | A | 5/2010 |
| KR | 10-2014-0014694 | A | 2/2014 |

* cited by examiner

*Primary Examiner* — Sanghyuk Park
(74) *Attorney, Agent, or Firm* — Lee & Morse P.C.

(57) ABSTRACT

An apparatus includes a controller to generate at least one pulse width modulated (PWM) signal to control a switch connected to a pixel circuit of a display device. The at least one PWM signal controls coupling of a current source or a current sink through the switch to the pixel circuit. When the PWM signal is applied during a first period, the PWM signal has a width sufficient to discharge a pixel capacitor. When the PWM signal is applied during a second period, the PWM signal has a width which is based on a data signal. The pixel circuit controls emission of light with a certain gray scale value based on the data signal.

18 Claims, 4 Drawing Sheets

ORGANIC LIGHT EMITTING DISPLAY DEVICE AND METHOD FOR DRIVING THE SAME

CROSS-REFERENCE TO RELATED APPLICATION

Korean Patent Application No. 10-2013-0095270, filed on Aug. 12, 2013, and entitled, "Organic Light Emitting Display Device and Method For Driving The Same," is incorporated by reference herein in its entirety.

BACKGROUND

1. Field

One or more embodiments described herein relate to a display device.

2. Description of the Related Art

Various types of flat panel displays have been developed. Examples include liquid crystal displays, organic light emitting displays, and plasma display panels. OLED displays generate based on a recombination of holes and electrons in an active layer. This types of displays are gaining increasing favor because of their fast response speed and low power consumption.

SUMMARY

In accordance with one embodiment, an organic light emitting display device includes a plurality of pixels; a data driver configured to supply data signals to data lines; a scan driver configured to progressively supply a first scan signal and a second scan signal to corresponding scan lines; and a control line driver configured to progressively supply an emission control signal to emission control lines, wherein each pixel: discharges a storage capacitor to an initialization voltage in a first period, charges a first power source supplied through a driving transistor in the storage capacitor in a second period, and charges or discharges the storage capacitor during a fourth period corresponding to a data signal in a third period.

Each pixel may include n organic light emitting diode (OLED); a pixel circuit configured to control current flowing from the first power source to a second power source through the OLED; and a data writing circuit configured to control a voltage charged in the storage capacitor of the pixel circuit based on the data signal. The data writing circuit may sink a first reference current from the storage capacitor during the first period, and may sink the first reference current to the storage capacitor or sources a second reference current to the storage capacitor during the fourth period.

The data writing circuit may include a current source unit configured to supply the first reference current; a current sink unit configured to supply the second reference current; a coupling control unit configured to supply a PWM control signal and a discharge control signal based on the data signal; and a switching unit configured to allow one of the current source unit or the current sink unit to be coupled to the pixel circuit based on the PWM control signal and the discharge control signal.

The switching unit may include a first switching circuit coupled to the pixel circuit, the first switching circuit to turn on based on the PWM control signal; a second switching circuit between the first switching element and current source unit, the second switching circuit to turn off based on to the discharge control signal; and a third switching circuit between the first switching element and current sink unit, the third switching circuit to turn on based on the discharge control signal.

The coupling control unit may include a PWM signal generating unit configured to supply the PWM control signal during the first and fourth periods based on the data signal; and a discharge control unit configured to supply the discharge control signal during the first period, and to supply the discharge control signal during the third period when a gray scale value corresponding to the data signal is lower than a reference gray scale value.

The pixel circuit may include a second transistor coupled between the first power source and a first electrode of the driving transistor, the second transistor to turn on based on the first or second scan signal supplied through a previous scan line among the scan lines; a third transistor coupled between a first electrode of the storage capacitor and a second electrode of the driving transistor, the third transistor to turn on based on the first or second scan signal supplied through the previous scan line; a fourth transistor coupled between the first electrode of the storage capacitor and the data writing circuit, the fourth transistor to turn on based on the first or second scan signal supplied through a current scan line among the scan lines; a fifth transistor coupled between the second electrode of the driving transistor and the organic light emitting diode, the fifth transistor to turn on based on the emission control signal supplied from a corresponding emission control line among the emission control lines; and a sixth transistor coupled between the first power source and the first electrode of the driving transistor, the sixth transistor to turn on based on the emission control signal supplied through the corresponding emission control line.

The first electrode of the storage capacitor may be coupled to a gate electrode of the driving transistor, and the second electrode of the storage capacitor may be coupled to the first power source. The first electrode of the driving transistor may be coupled to the second and sixth transistors, the second electrode of the driving transistor may be coupled to the third and fifth transistors, and the gate electrode of the driving transistor may be coupled to the first electrode of the storage capacitor.

In accordance with another embodiment, a method for driving an organic light emitting display device includes discharging a storage capacitor of a pixel to an initial voltage; charging the storage capacitor to an intermediate voltage by supplying a first power source through a driving transistor of the pixel; and charging or discharging the storage capacitor during a period corresponding to a data signal. Discharging the storage capacitor of the pixel to the initial voltage includes sinking current from the storage capacitor. The method may include applying current to an organic light emitting diode (OLED) of the pixel to cause the OLED to emit light with a luminance based on the voltage charged in the storage capacitor.

In accordance with another embodiment, an apparatus includes a switch; and a controller to generate at least one pulse width modulated (PWM) signal to control the switch, wherein the at least one PWM signal is to control coupling of a current source or a current sink through the switch to a pixel circuit. The switch may be on for a time sufficient to discharge a capacitor of the pixel circuit to a first voltage, and the time may correspond to a width of the at least one PWM signal.

The switch may be on for a time sufficient to charge a capacitor of the pixel circuit, and the time may correspond to a width of the at least one PWM signal. A width of the at least one PWM signal may be based on a data signal.

The at least one PWM signal may couple the current source to the pixel circuit through the switch when a gray scale value of a data signal is in a first range and the at least one PWM signal may couple the current sink to the pixel circuit through the switch when the gray scale value of the data signal is in a second range different from the first range. The first range and the second range may be separated by a gray scale reference value.

The controller may generate two PWM signals to control the switch, a first PWM signal may have a width sufficient to discharge of a pixel capacitor in the pixel circuit during a first period, and a second PWM signal may have a width sufficient to charge the pixel capacitor based on a data signal in another a second period. The controller may generate the at least one PWM signal in synchronism with a scan signal of the pixel circuit.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
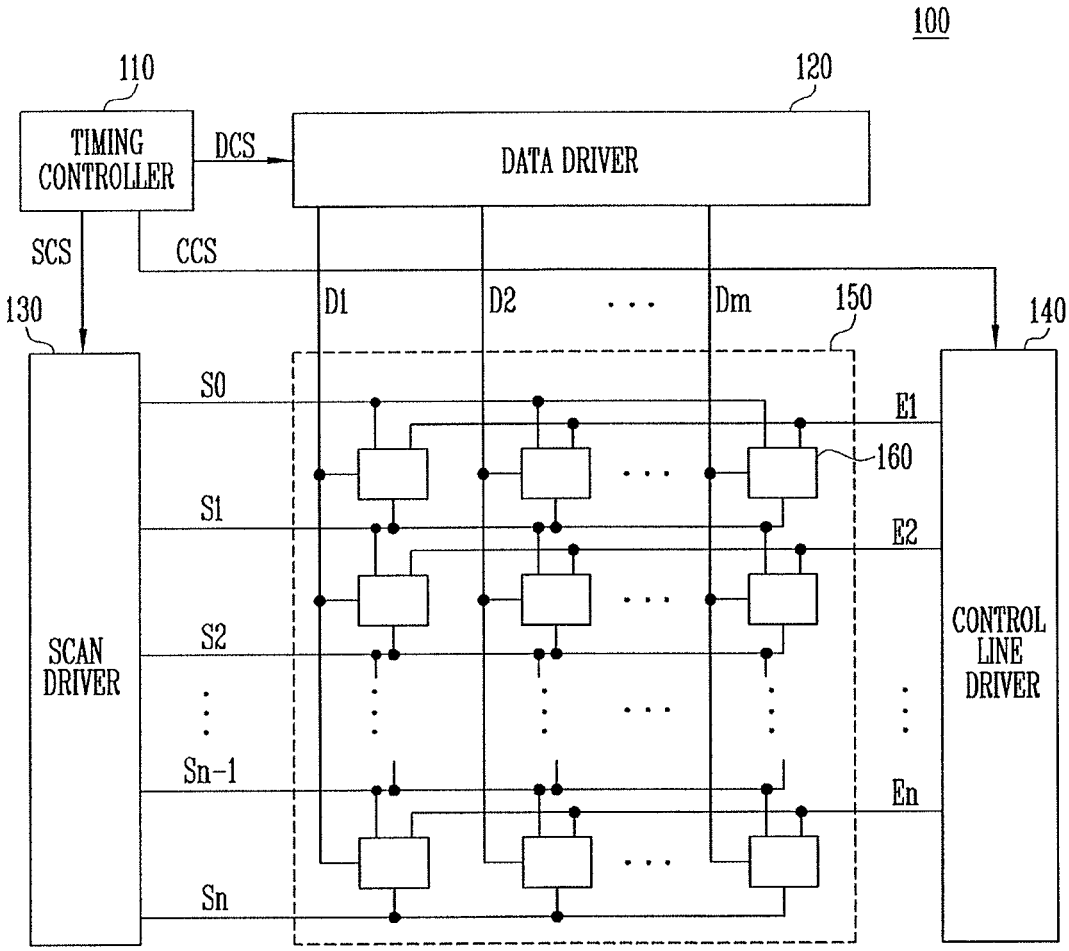
FIG. 1 illustrates an embodiment of an organic light emitting display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 illustrates an embodiment of an organic light emitting display device 100 which includes a timing controller 110, a data driver 120, a scan driver 130, a control line driver 140, and a display unit 150.

The timing controller 110 controls operations of data driver 120, scan driver 130, and control line driver 140 based on a synchronization signal supplied from an external source. The timing controller 110 generates a data driving control signal DCS for input into to data driver 120. The timing controller 110 generates a scan driving control signal SCS for input into scan driver 130. The timing controller 110 generates a control line driving control signal CCS for input into control line driver 140. Also, timing controller 110 supplies data to data driver 120 supplied from a external source.

The data driver 120 realigns data from timing controller 110 and supplies the realigned data as data signals to data lines D1 to Dm. This operation may be performed in response to the data driving control signal DCS from the timing controller 110.

The scan driver 130 progressively supplies a first scan signal SS1 and a second scan signal SS2 to scan lines S0 to Sn, in response to the scan driving control signal SCS output from timing controller 110. The second scan signal SS2 may be supplied after a predetermined time elapses from the time when the first scan signal SS1 is supplied. That is, scan driver 130 may supply the first scan signal SS1 to any one scan line among scan lines S0 to Sn, and may supply the second scan signal SS2 to the one scan line after the predetermined time elapses.

The control line driver 140 progressively supplies an emission control signal to emission control lines E1 to En. This operation may be performed in response to the control line driving control signal CCS output from timing controller 110.

The display unit 150 includes pixels 160 respectively disposed at intersection areas of data lines D1 to Dm, scan lines S0 to Sn, and emission control lines E1 to En. In this embodiment, the data lines D1 to Dm are arranged in a vertical direction. The scan lines S0 to Sn are arranged in a horizontal direction.

Each pixel 160 is coupled to a corresponding one of data lines D1 to Dm, two corresponding scan lines among scan lines S0 to Sn, and a corresponding one of emission control lines E1 to En.

Figure 4:
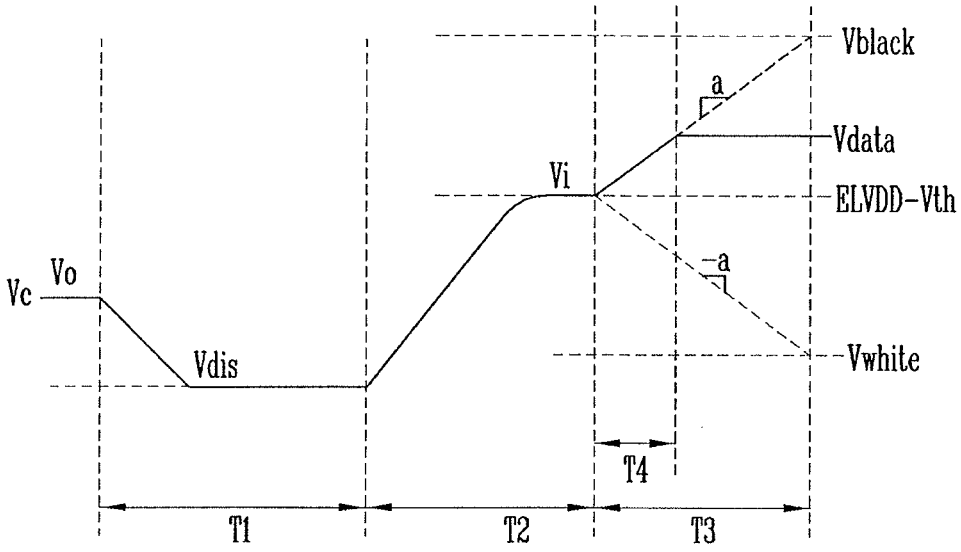
FIG. 4 illustrates an example of a change in voltage of a pixel capacitor.

Each pixel 160 discharges a storage capacitor (Cst of FIG. 2) to an initialization voltage (Vdis of FIG. 4). Each pixel also charges the storage capacitor Cst based on a first power source (ELVDD of FIG. 2) supplied through a driving transistor (M1 of FIG. 2). Each pixel 160 may charge or discharge storage capacitor Cst during a period corresponding to the data signal. Subsequently, each pixel 160 emits light with a luminance corresponding to the voltage charged in the storage capacitor Cst.

Figure 2:
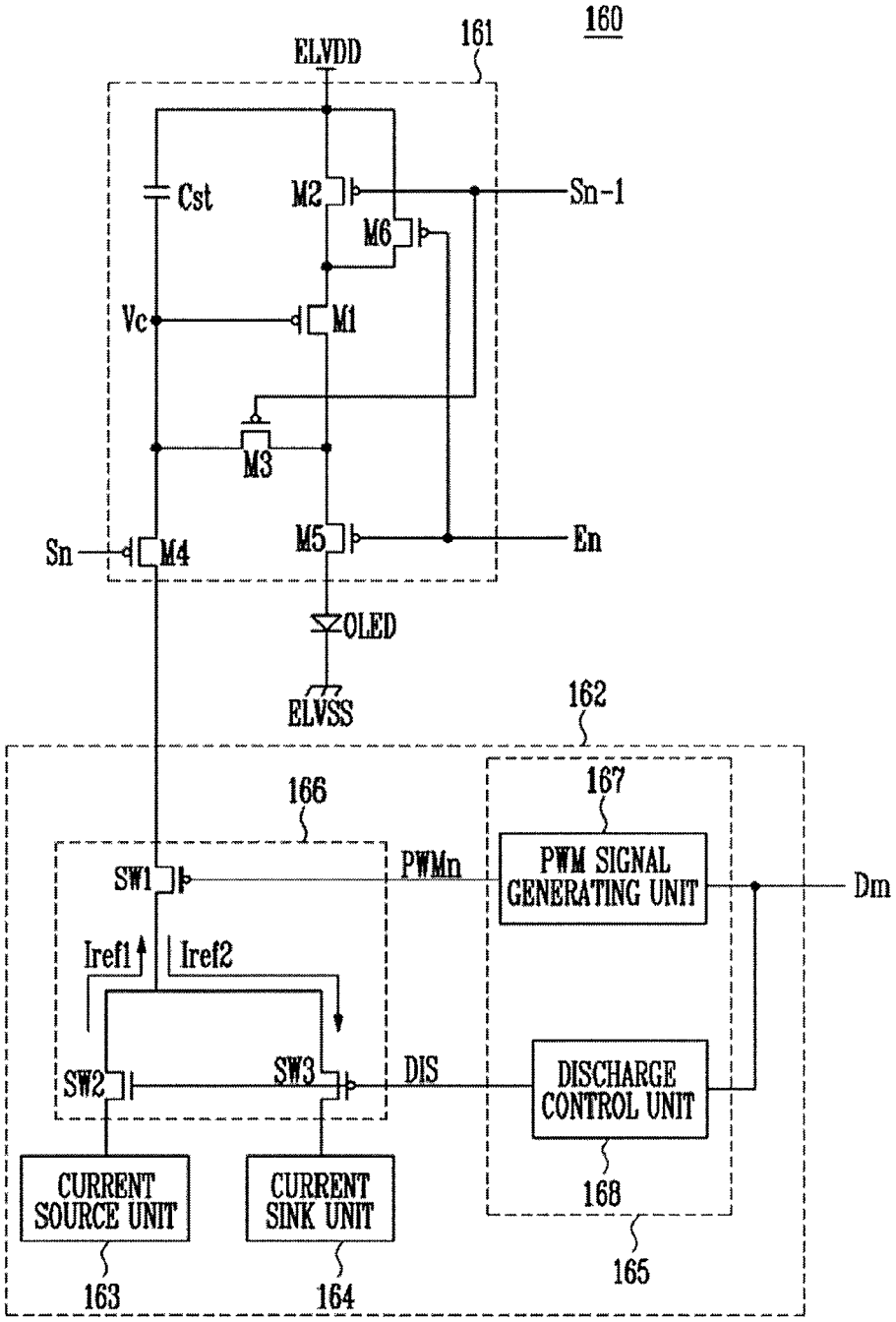
FIG. 2 illustrates an embodiment of a pixel.
Figure 3:
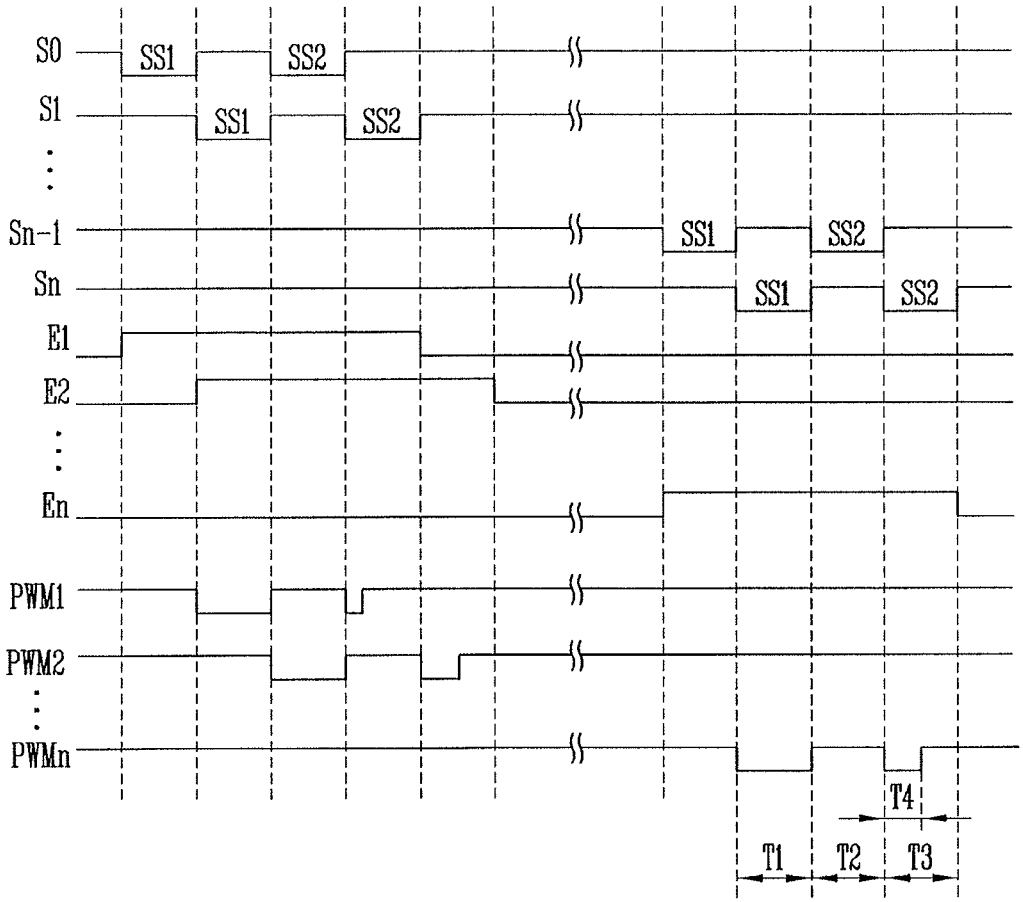
FIG. 3 illustrates a embodiment of a method for controlling a display device.

FIG. 2 illustrates an embodiment of a pixel, which, for example, may be any of the pixels 160 in FIG. 1. FIG. 3 is a timing diagram illustrating operation of the display device in FIG. 1. FIG. 4 is a graph illustrating a change in voltage of a capacitor in the pixel of FIG. 2.

Referring to FIGS. 1 to 4, pixel 160 includes a pixel circuit 161, a data writing circuit 162, and an organic light emitting diode (OLED). The pixel circuit 161 is coupled between a first power source ELVDD and an anode electrode of the OLED. The pixel circuit 161 controls current flowing from the first power source ELVDD to a second power source ELVSS through the OLED, in response to control signals supplied from a previous scan line Sn-1, a current scan line Sn, and an emission control line En.

The previous scan lines Sn-1 may correspond to a scan line through which scan signals SS1 to SS2 are supplied at a time earlier than another scan line, e.g., scan lines Sn-1 and Sn in FIG. 2. A current scan line Sn may correspond to a scan line through which scan signals SS1 and SS2 are supplied at a time later than another scan line.

Also, FIG. 2 shows an embodiment that includes PMOS transistors Accordingly, the supply of a signal may be understood to mean a low-level signal. In another embodiment, NMOS transistors may be used, with signals being applied at a high level.

The pixel circuit 161 includes a storage capacitor Cst and transistors M1 to M6. In other embodiments, the pixel circuit 161 may have a different structure, e.g., a different number of transistors and/or capacitors.

The storage capacitor Cst is coupled between the first power source ELVDD and a driving transistor, e.g., a gate electrode of the first transistor M1. For example, a first electrode of the storage capacitor Cst is coupled to the gate electrode of the first transistor M1. A second electrode of the storage capacitor Cst is coupled to the first power source ELVDD.

The first transistor M1 is coupled between the second transistor M1 and a node between the third and fifth transistors M3 and M5. For example, a first electrode of the first transistor M1 is coupled to the second transistor M2. A second electrode of the first transistor M1 is coupled to the node between the third and fifth transistors M3 and M5. The gate electrode of the first transistor M1 is coupled to the first electrode of the storage capacitor Cst.

The second transistor M2 is coupled between the first power source ELVDD and the first electrode of the first transistor M1. The second transistor M2 is turned on in response to the first or second scan signal SS1 or SS2 supplied through previous scan line Sn-1.

The third transistor M3 is coupled between the first electrode of the storage capacitor Cst and the second electrode of the first transistor M1. The third transistor M3 is turned on in response to the first or second scan signal SS1 or SS2 supplied through previous scan line Sn-1. When the third transistor M3 turns on, the first and third transistors M1 and M3 are diode-coupled.

The fourth transistor M4 is coupled between the first electrode of the storage capacitor Cst and the data writing circuit 162. The fourth transistor M4 turns on in response to first or second scan signal SS1 or SS2 supplied through current scan line Sn.

The fifth transistor M5 is coupled between the second electrode of the first transistor M1 and the anode electrode of the OLED. The fifth transistor M5 is turned on in response to an emission control signal supplied through an emission control line En.

The sixth transistor M6 is coupled between the first power source ELVDD and the first electrode of the first transistor M1. The sixth transistor M6 is turned on in response to the emission control signal supplied through the emission control line En.

During a first period T1, the first scan signal SS1 is supplied through the current scan line Sn, in order to turn on fourth transistor M4. Thus, a current path from data writing circuit 162 to the first electrode of storage capacitor Cst is formed during the first period T1.

During a second period T2, the second scan signal SS2 is supplied through previous scan line Sn-1 to turn on second and third transistors M2 and M3. In this case, the first and third transistors M1 and M3 are diode-coupled. Thus, a current path from the first power source ELVDD to the first electrode of the storage capacitor Cst through the first transistor M1 is formed during the second period T2.

During a third period T3, the second scan signal SS2 is supplied through the current scan line Sn to turn on fourth transistor M4. Thus, a current path from data writing circuit 162 to the first electrode of the storage capacitor Cst is formed during the third period T3.

The data writing (controller) circuit 162 controls a voltage Vc stored (charged) in the storage capacitor Cst of the pixel circuit 161. The voltage Vc is stored in storage capacitor Cst in response to a data signal supplied through data line Dm. For example, data writing circuit 162 sinks a second reference current Iref2 from storage capacitor Cst during first period T1. The data writing circuit 162 sinks the second reference current Iref2 from storage capacitor Cst, or sources a first reference current Iref1 to the storage capacitor Cst, during a fourth period T4 based on the data signal in third period T3. The first and second reference currents Iref1 and Iref2 may have the same amplitude and opposite polarities, for example.

The data writing circuit 162 includes a current source unit 163, a current sink unit 164, a coupling control unit 165, and a switching unit 166. The current source unit 163 supplies the first reference current Iref1 through switching unit 166 to pixel circuit 161. Specifically, when the switching unit 166 allows the pixel circuit 161 and current source unit 163 to be coupled to each other, the current source unit 163 charges the storage capacitor Cst of the pixel circuit 161.

The current sink unit 164 supplies the second reference current Iref2 through switching unit 166. Specifically, when switching unit 166 allows the pixel circuit 161 and current sink unit 164 to be coupled to each other, current sink unit 164 discharges storage capacitor Cst of pixel circuit 161. Each of the current source unit 163 and the current sink unit 164 may be implemented, for example, by a diode or amplifier which can supply constant current.

The coupling control unit 165 supplies a PWM control signal PWMn and a discharge control signal DIS to the switching unit 166, in response to the data signal supplied through data line Dm. The coupling control unit 165 includes a PWM signal generating unit 167 and a discharge control unit 168.

The PWM signal generating unit 167 supplies the PWM control signal PWMn to switching unit 166 during first period T1. The PWM signal generating unit 167 supplies the PWM control signal PWMn during the fourth period T4 corresponding to the data signal in the third period T3.

The discharge control unit 168 supplies the discharge control signal DIS to switching unit 166 during the first period T1. The discharge control unit 168 supplies the discharge control signal DIS to the switching unit 166 during the third period T3. Specifically, when the gray scale value of the data signal is lower than a reference gray scale value, the discharge control unit 168 does not supply the discharge control signal DIS during the third period T3. When the gray scale value of the data signal is higher than the reference gray scale value, the discharge control unit 168 supplies the discharge control signal DIS during the third period T3. The reference gray scale value may correspond to a value Vi of FIG. 4.

The switching unit 166 allows one of the current source unit 163 or the current sink unit 164 to be electrically coupled to the pixel circuit 161, in response to PWM control signal PWMn and discharge control signal DIS. The switching unit 166 includes a plurality of switching elements SW1 and SW3.

The first switching element SW1 is coupled between the pixel circuit 161 and the other switching element SW2 and SW3. The first switching element SW1 is turned on in response to PWM control signal PWMn supplied from coupling control unit 165.

The second switching element SW2 is coupled between first switching element SW1 and current source unit 163. The second switching element SW2 is turned off in response to discharge control signal DIS supplied from the discharge control unit 168.

The third switching element SW3 is coupled between first switching element SW1 and current sink unit 164. The third switching element SW3 is turned on in response to discharge control signal DIS supplied from the discharge control unit 168.

The fourth transistor M4 of the pixel circuit 161 and the first and third switching elements SW1 and SW3 of the data writing circuit 162 are turned on during the first period T1. Thus, a current path is formed from the first electrode of the storage capacitor Cst to the current sink unit 164. Because the current sink unit 164 sources the second reference current Iref2 from the first electrode of the storage capacitor Cst, the storage capacitor Cst is discharged.

In one embodiment, the voltage Vc charged in the storage capacitor Cst during the first period T1 is decreased with a constant slope from an initialization voltage Vo. Because voltage Vc charged in storage capacitor Cst is saturated at the discharge voltage Vdis, voltage Vc is no longer decreased.

The second and third transistors M2 and M3 of the pixel circuit 161 are turned on during the second period T2. Thus, a current path is formed from the first power source ELVDD to the first electrode of the storage capacitor Cst through the first transistor M1. In this case, the voltage of the first power source ELVDD is supplied to the storage capacitor Cst and the storage capacitor Cst is charged.

The voltage Vc charged in the storage capacitor Cst during the second period T2 is increased. Because the voltage Vc charged in the storage capacitor Cst is saturated at a voltage based on a difference between the threshold voltage Vth of the first transistor M1 and the voltage of the first power source ELVDD, the voltage Vc is no longer increased.

The fourth transistor M4 of the pixel circuit 161 is turned on during the third period T3. The first switching element SW1 of the data writing circuit 162 is turned on during the fourth period T4 based on the data signal in the third period T3. The first switching element SW1 is turned on for a time proportional to the difference between the gray scale value indicated by the data signal and the reference gray scale value. One of the second or third switching elements SW2 and SW3 is turned on according to the gray scale value indicated by the data signal supplied through data line Dm during the third period T3.

In one embodiment, the gray scale value of the data signal may be lower than the reference gray scale value. In this case, the second switching element SW2 is turned on during the third period T3. The first switching element SW1 is turned on during the fourth period T4 corresponding to the data signal. Thus, a current path is formed from the current source unit 163 to the first electrode of the storage capacitor Cst during the fourth period T4. The storage capacitor Cst is charged in response to the first reference current Iref1 supplied from the current source unit 163 during the fourth period T4. The voltage Vc charged in the storage capacitor Cst is increased during the fourth period T4. After the third period T3, a voltage Vdata corresponding to the data signal is charged in the storage capacitor Cst.

After the third period T3, the emission control signal is supplied to the emission control line En. In this case, pixel 160 emits light with a luminance corresponding to the voltage Vdata obtained by compensating for the threshold voltage of first transistor M1.

In an alternative embodiment, the PWM signal generating unit may be replaced with a controller that generates a control signal having an adjustable duty cycle. The duty cycle may be adjusted to have a predetermined logical value (e.g., a logical 0 for a PMOS transistor implementation) for controlling switch SW1 to be turned on for a time sufficient to discharge storage capacitor Cst during time period T1. In one embodiment, the duty cycle may be a fixed value during this period. The duty cycle may be adjusted to have a predetermined logical value (e.g., logical 0 for a PMOS transistor implementation) in a different time period, e.g., time period T3. During this period, the duty cycle may be adjusted based on a data signal, so that a voltage corresponding to a gray scale value of the data signal is stored in capacitor Cst.

By way of summation and review, one or more of the aforementioned embodiments provide an organic light emitting display device and method for driving the same which displays images with uniform luminance by compensating for differences in the threshold voltages of driving transistors.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. An organic light emitting display device, comprising:
- a plurality of pixels;
- a data driver to supply data signals to data lines;
- a scan driver to supply a first scan signal and a second scan signal to corresponding scan lines; and
- a control line driver to supply an emission control signal to emission control lines, wherein each pixel:
- discharges a storage capacitor to an initialization voltage using a sinking current flowing out of the storage capacitor in a first period,
- charges the storage capacitor through a driving transistor using a first power source in a second period,
- is determined whether the storage capacitor is charged or discharged based on a level of a data signal, and
- charges the storage capacitor using a sourcing current flowing in the storage capacitor during a fourth period of a third period when the storage capacitor is determined to be charged, and discharges the storage capacitor using the sinking current during the fourth period when the storage capacitor is determined to be discharged, the fourth period being adjusted according to the level of the data signal.

2. The display device as claimed in claim 1, wherein each pixel includes:
- an organic light emitting diode (OLED);
- a pixel circuit to control current flowing from the first power source to a second power source through the OLED; and
- a data writing circuit to control a voltage charged in the storage capacitor of the pixel circuit based on the data signal.

3. The display device as claimed in claim 2, wherein the data writing circuit is to sink a first reference current as the sinking current from the storage capacitor during the first period, and is to sink the first reference current to the storage capacitor or source a second reference current as the sourcing current to the storage capacitor during the fourth period.

4. The display device as claimed in claim 3, wherein the data writing circuit includes:

a current source to supply the first reference current;

a current sink to supply the second reference current;

a coupling controller to supply a PWM control signal and a discharge control signal based on the data signal; and a switching circuit to allow one of the current source or the current sink to be coupled to the pixel circuit based on the PWM control signal and the discharge control signal.

5. The display device as claimed in claim 4, wherein the switching circuit includes:

a first switching circuit coupled to the pixel circuit, the first switching circuit to turn on based on the PWM control signal;

a second switching circuit between the first switching circuit and current source unit, the second switching circuit to turn off based on to the discharge control signal; and a third switching circuit between the first switching circuit and current sink, the third switching circuit to turn on based on the discharge control signal.

6. The display device as claimed in claim 5, wherein the coupling controller includes:

a PWM signal generator to supply the PWM control signal during the first and fourth periods based on the data signal; and a discharge controller to supply the discharge control signal during the first period, and to supply the discharge control signal during the third period when a gray scale value corresponding to the data signal is lower than a reference gray scale value.

7. The display device as claimed in claim 2, wherein the pixel circuit includes:

a second transistor coupled between the first power source and a first electrode of the driving transistor, the second transistor to turn on based on the first or second scan signal supplied through a previous scan line among the scan lines;

a third transistor coupled between a first electrode of the storage capacitor and a second electrode of the driving transistor, the third transistor to turn on based on the first or second scan signal supplied through the previous scan line;

a fourth transistor coupled between the first electrode of the storage capacitor and the data writing circuit, the fourth transistor to turn on based on the first or second scan signal supplied through a current scan line among the scan lines;

a fifth transistor coupled between the second electrode of the driving transistor and the organic light emitting diode, the fifth transistor to turn on based on the emission control signal supplied from a corresponding emission control line among the emission control lines; and a sixth transistor coupled between the first power source and the first electrode of the driving transistor, the sixth transistor to turn on based on the emission control signal supplied through the corresponding emission control line.

8. The display device as claimed in claim 7, wherein: the first electrode of the storage capacitor is coupled to a gate electrode of the driving transistor, and the second electrode of the storage capacitor is coupled to the first power source.

9. The display device as claimed in claim 8, wherein:

the first electrode of the driving transistor is coupled to the second and sixth transistors, the second electrode of the driving transistor is coupled to the third and fifth transistors, and the gate electrode of the driving transistor is coupled to the first electrode of the storage capacitor.

10. A method for driving an organic light emitting display device, the method comprising:

discharging a storage capacitor of a pixel to an initial voltage using a sinking current flowing out of the storage capacitor;

charging the storage capacitor to an intermediate voltage using a first power source through a driving transistor of the pixel;

determining whether the storage capacitor is charged or discharged from the intermediate voltage based on a level of a data signal; and charging the storage capacitor using a sourcing current flowing in the storage capacitor during a period when the storage capacitor is determined to be charged, and discharging the storage capacitor using the sinking current during the period when the storage capacitor is determined to be discharged, the period being adjusted according to the level of the data signal.

11. The method as claimed in claim 10, further comprising:

applying current to an organic light emitting diode (OLED) of the pixel to cause the OLED to emit light with a luminance based on the voltage charged in the storage capacitor.

12. An apparatus, comprising:

a pixel circuit having a storage capacitor and a driving transistor;

a switch; and a controller to generate at least one pulse width modulated (PWM) signal to control the switch, wherein the at least one PWM signal is to control coupling of a sourcing current or a sinking current through the switch to the storage capacitor of the pixel circuit, wherein the storage capacitor is discharged to an initialization voltage using the sinking current flowing out of the storage capacitor, is charged through the driving transistor using a first power source, and is determined whether the storage capacitor is charged or discharged based on a level of a data signal, wherein the storage capacitor is charged using the sourcing current flowing in the storage capacitor during a width of the at least one PWM signal when the storage capacitor is determined to be charged, and is discharged using the sinking current during the width of the at least one PWM signal when the storage capacitor is determined to be discharged, and wherein the width of the at least one PWM signal is adjusted according to the level of the data signal.

13. The apparatus as claimed in claim 12, wherein the switch is turned on for a time sufficient to charge the storage capacitor of the pixel circuit when the storage capacitor is determined to be charged, and wherein the time corresponds to the width of the at least one PWM signal.

14. The apparatus as claimed in claim 12, wherein:

the at least one PWM signal is to couple the sourcing current to the storage capacitor of the pixel circuit through the switch when a gray scale value of the data signal is in a first range and the at least one PWM signal is to couple the sink current to the storage capacitor of the pixel circuit through the switch when the gray scale value of the data signal is in a second range different from the first range.

15. The apparatus as claimed in claim 14, wherein the first range and the second range are separated by a gray scale reference value.

16. The apparatus as claimed in claim 12, wherein:

the controller generates two PWM signals to control the switch, a first PWM signal has a width sufficient to discharge the storage capacitor in the pixel circuit to the initialization voltage during a first period, and a second PWM signal has a width sufficient to charge the storage capacitor through the driving transistor based on the data signal during a second period.

17. The apparatus as claimed in claim 12, wherein the controller generates the at least one PWM signal in synchronism with a scan signal of the pixel circuit.

18. The apparatus as claimed in claim 12, wherein the switch is turned on for a time sufficient to discharge the storage capacitor of the pixel circuit when the storage capacitor is determined to be discharged, and wherein the time corresponds to the width of the at least one PWM signal.

* * * * *